US011287217B2

(12) United States Patent
Weinland

(10) Patent No.: US 11,287,217 B2
(45) Date of Patent: Mar. 29, 2022

(54) ADJUSTABLE SIGHTING DEVICE FOR FIREARMS

(71) Applicant: Thomas Weinland, Hamburg (DE)

(72) Inventor: Thomas Weinland, Hamburg (DE)

( * ) Notice: Subject to any disclaimer, the term of this patent is extended or adjusted under 35 U.S.C. 154(b) by 35 days.

(21) Appl. No.: 16/971,003

(22) PCT Filed: Feb. 20, 2019

(86) PCT No.: PCT/EP2019/054135
§ 371 (c)(1),
(2) Date: Sep. 16, 2020

(87) PCT Pub. No.: WO2019/162287
PCT Pub. Date: Aug. 29, 2019

(65) Prior Publication Data

US 2021/0003366 A1 Jan. 7, 2021

(30) Foreign Application Priority Data

Feb. 20, 2018 (DE) ..... 202018100924.9

(51) Int. Cl.
*F41G 1/24* (2006.01)
*F41G 11/00* (2006.01)

(52) U.S. Cl.
CPC ..... *F41G 1/24* (2013.01); *F41G 11/003* (2013.01)

(58) Field of Classification Search
CPC . F41G 11/003; F41G 1/24; F41G 1/06; F41G 1/10; F41G 1/16; F41G 1/17; F41G 1/18; F41G 1/20; F41G 1/22; F41G 1/26; F41G 1/28
USPC ..... 42/137, 133, 147, 148, 136, 138, 135
See application file for complete search history.

(56) References Cited

U.S. PATENT DOCUMENTS 3,748,744 A 7/1973 McClenahan
4,127,943 A * 12/1978 Tiritilli ..... F41G 1/28 42/138
4,192,075 A * 3/1980 Strahan ..... F41G 1/425 42/137
4,200,989 A 5/1980 Brouthers
(Continued)

FOREIGN PATENT DOCUMENTS

DE 701801 1/1941
DE 3635035 6/1987
(Continued)

*Primary Examiner* — John Cooper
(74) *Attorney, Agent, or Firm* — Sand, Sebolt & Wernow Co., LPA

(57) ABSTRACT

A firearm sighting device having a base, a first sighting lever arm pivotable relative to the base around a first pivot axis, a second sighting lever arm pivotable relative to the base and first sighting lever arm around a second pivot axis, a rear sight device fixed on the second sighting lever arm, a first positioning device for adjusting a pivot angle of the first sighting lever arm relative to the base, and a second positioning device for adjusting a pivot angle of the second sighting lever arm relative to the first sighting lever arm and the base. A rotating positioning element on the first sighting lever arm includes alignment elements that each have a positioning tip so that a distance between the positioning tip and rotating positioning element is adjustable. A buttress element on the bottom of the base interacts with the positioning tips.

20 Claims, 3 Drawing Sheets

(56) References Cited

U.S. PATENT DOCUMENTS

| | | | |
|---|---|---|---|
| 7,526,890 | B1 | 5/2009 | Keng et al. |
| 2011/0308132 | A1 | 12/2011 | Hewes |
| 2013/0061511 | A1 | 3/2013 | Strayer |

FOREIGN PATENT DOCUMENTS

| | | |
|---|---|---|
| DE | 202005007224 | 9/2006 |
| DE | 202011107430 | 12/2011 |
| DE | 202018103406 | 6/2018 |
| EP | 0117845 | 9/1984 |
| EP | 1719967 | 11/2006 |

* cited by examiner

ADJUSTABLE SIGHTING DEVICE FOR FIREARMS

TECHNICAL FIELD

The invention relates to a sighting device for firearms, in particular for handguns, having the features of a base, a first sighting lever arm pivotable relative to the base around a first pivot axis, a second sighting lever arm pivotable relative to the base and relative to the first sighting lever arm around a second pivot axis, wherein the second pivot axis extends in parallel to the first pivot axis, a rear sight device fixed on the second sighting lever arm, a first positioning device for adjusting a pivot angle of the first sighting lever arm relative to the base, and a second positioning device for adjusting a pivot angle of the second sighting lever arm relative to the first sighting lever arm and relative to the base.

BACKGROUND

Background Information

Such sighting devices are known in manifold forms. They form a component of a targeting device, using which the correspondingly equipped firearms can be aligned on the target by means of aiming at a target via rear and front sights.

Such sighting devices are fundamentally provided as firearm components permanently integrated into firearms, in particular into handguns, such as revolvers or pistols. In pistols, for example, they can be designed permanently installed on the slide, which encloses the chamber. However, such sighting devices also exist as separate units, which are arranged on the respective firearm and fixed thereon, for example, fastened via retaining screws screwed into threaded holes provided in the corresponding firearm.

In particular, sighting devices are also already known in this case, which have a base and two individual sighting lever arms each pivotable individually around a pivot axis arranged thereon, wherein the pivot axes extend in parallel to one another. The two sighting lever arms are then each individually adjustable in their pivot angle via a separate positioning device. An adjustment of the pivot angles of the sighting lever arms is used here for a vertical adjustment of the rear sight device, which is typically fixed on the second sighting lever arm, to thus adjust the point of impact of the firearm with regard to the impact height. The fact that two sighting lever arms and two positioning devices are provided here is used in this case to offer a rapid adjustment option. Thus, for example, by adjusting a first of the two sighting lever arms, a fundamental point of impact can be set, then, for example, a daily setting can be performed via an adjustment of the positioning device on the second of the two sighting lever arms, for example, in dependence on a shooting discipline exercised in sport using the firearm or also in dependence on the light conditions or vision conditions on the respective shooting day (for example, a competition day) or also in dependence on different ammunition used, in particular having different charges and different flight paths thus provided. An adaptation to a distance of the target to be fired at can also be performed in this way, for example, again in accordance with different competitive disciplines.

Known such sighting devices have the disadvantage that they only have a low level of operating convenience, in particular the adjustment of different preset sighting settings is only possible with difficulty. This is true in particular for those sighting devices which are used for handguns, since they are limited in their dimensioning due to the construction, which has heretofore had the result that convenient approaches which are nonetheless implementable in the context of the available dimensions could not be found.

SUMMARY

A remedy is to be provided here by the invention, wherein in particular a sighting device of the type mentioned at the outset is to be refined in such a way that multiple different basic settings of the sighting device for different points of impact can be performed using it and can be selected easily and quickly in use.

This object is achieved by a sighting device having the features that the first positioning device has a rotating positioning element which is fixed on the first sighting lever arm, is pivotable around a rotational axis extending perpendicularly to the first pivot axis, is equipped with a plurality of alignment elements arranged distributed in different angle positions around the rotational axis, wherein the alignment elements each have a positioning tip oriented toward a bottom of the base and can be fixedly aligned relative to the rotating positioning element in such a way that a distance of the positioning tip to the rotating positioning element is variably adjustable in a direction parallel to the rotational axis, wherein a buttress element elevated over a surrounding region covered by the rotating positioning element is provided on the bottom of the base to interact with one of the positioning tips at a time.

Advantageous refinements of such a sighting device according to the invention may include that the alignment elements may be arranged along the circumference of a circle located in a plane perpendicular to the rotational axis and drawn around the intersection of the rotational axis with this plane. The alignment elements may be arranged distributed at equal angle intervals around the rotational axis. The rotating positioning element may have precisely 6 alignment elements arranged distributed around the rotational axis. The alignment elements may be formed as grub screws, which are screwed into threaded holes in the rotating positioning element. The positioning tips of the alignment elements may be formed rounded, in particular in the form of a spherical cap, and in that the buttress element may have a corresponding depression complementary to the shape of the rounded positioning tips of the alignment elements. The rotating positioning element may be arranged between the base and the first sighting lever arm, and in that an actuating element fixedly connected to the rotating positioning element for pivoting the rotating positioning element around the rotational axis may be arranged on an upper side of the first sighting lever arm facing away from the base. Markings on the actuating element may be provided to identify a rotational position of the rotating positioning element. Recesses may be provided circumferentially in the actuating element, through which an alignment element arranged in the rotating positioning element may be accessible at least in one rotational position for an adjustment of the positioning tip relative to the rotating positioning element. The first sighting lever arm may be mounted pivotably around the first pivot axis on the base, and the second sighting lever arm may be mounted pivotably on the first sighting lever arm. A spring means which may pre-tension the first and the second sighting lever arms in a basic position, wherein this basic position may be a pivot position of the two sighting lever arms oriented toward the base. The second positioning device may include a set screw, which may be aligned having a thread axis perpendicular to the second pivot axis, and may be fixed immovably on the second sighting lever arm in the direction of its thread axis, and may be rotatable in relation to the second sighting lever arm around the thread axis, and may be screwed into a threaded hole in the first sighting lever arm. Setting markings may be applied to the head of the set screw. The rear sight device may be fixed adjustably in its position on the second sighting lever arm in a direction parallel to the second pivot axis. The rear sight device may have a rear sight part receptacle for releasably fastening different rear sight parts. A Picatinny rail may be formed in the base, and which may overlap the region of the first and the second sighting lever arm. The sighting device may be designed as a separate unit for fastening on a firearm, in particular a handgun. The sighting device may be formed integrated in a firearm, in particular in a handgun, for example, as part of a barrel assembly, a breech, a frame assembly, or a chamber housing.

According to the invention, a sighting device for firearms, in particular for handguns, firstly has as essential components a base, a first sighting lever arm pivotable relative to the base around a first pivot axis, a second sighting lever arm pivotable relative to the base and relative to the first sighting lever arm, wherein the second pivot axis extends in parallel to the first pivot axis, a rear sight device fixed on the second sighting lever arm, a first positioning device for adjusting a pivot angle of the first sighting lever arm relative to the base, and a second positioning device for adjusting a pivot angle of the second sighting lever arm relative to the first sighting lever arm and relative to the base.

The special feature of the sighting device according to the invention is the design of the first positioning device. According to the invention, it has a rotating positioning element, which is fixed on the first sighting lever arm and at the same time is pivotable around a rotational axis extending perpendicularly to the first pivot axis. The rotating positioning element is pivotable in particular relative to the first sighting lever arm and also relative to the base here. The rotating positioning element furthermore has a plurality of alignment elements arranged distributed in different angle positions around the rotational axis, with which it is equipped. These alignment elements each have a positioning tip oriented toward a bottom of the base and can be aligned fixably in relation to the rotating positioning element in such a way that a distance of the positioning tip is variably adjustable with respect to the rotating positioning element in a direction parallel to the rotational axis. Finally, a buttress element elevated over a surrounding region overlaid by the rotating positioning element is provided on the bottom of the base, which is formed to interact with one of the positioning tips at a time.

This design according to the invention permits the presetting of a plurality of sighting settings, in particular settings of the point of impact, by way of a corresponding pivot adjustment of the rear sight device. The plurality of alignment elements forms a corresponding number of preset or pre-settable pivot angles of the first sighting lever arm in relation to the base. This is because by rotating the rotating positioning element around the rotational axis, one of the alignment elements at a time can be positioned with its positioning tip on the buttress element and thus specifies an exact vertical positioning of the rotating positioning element relative to the base and thus a pivot angle of the first sighting lever arm relative to the base. The alignment element can now be adjusted in its relative position in the rotating positioning element such that a desired elevation of impact is achieved in this sighting setting. For example, such an adjustment can be performed for firing at a target at a first distance, for example, in the case of a handgun firing at a sheet arranged at 15 m, and/or for firing using a first type of ammunition having corresponding charge strength. By pivoting the rotating positioning element into a further position, in which another alignment element rests with its positioning tip on the buttress element, the firearm equipped with the sighting device according to the invention can now be sighted in for a second basic setting of the point of impact, for example, for firing at another distance, for example, at a sheet arranged at 50 m distance and/or for firing using ammunition having differing charge and thus a different projectile trajectory. Depending on the number of the alignment elements arranged in the rotating positioning element, a corresponding number of sighting presets can be performed. If the firearm equipped with the sighting device according to the invention is then used, for example, in a competition in a specific shooting discipline, a preset performed by the user beforehand using a specific alignment element for this shooting discipline and/or a corresponding type of ammunition can be selected quickly by pivoting the rotating positioning element into the position in which the corresponding alignment element rests with its positioning tip on the buttress element and can thus be set. If, for example, due to given light conditions or other conditions given at the time of the shooting, in particular the competition, the point of impact should require a further correction in height, this can be carried out according to the invention by actuating the second positioning device and thus pivoting the second sighting lever arm, so that the basic setting, which is performed by corresponding adjustment of the respective alignment element, does not have to be changed. The shooter can maintain this basic setting and can make use of this basic setting unchanged every time when he is faced with the target situation matching with this basic setting, for example, shooting a specific competitive discipline.

The sighting device according to the invention thus permits, on the one hand, presetting a plurality of sighting settings for different aiming positions, different competitive disciplines, different ammunition use, or the like. On the other hand, it permits a daily setting by means of the second positioning device and pivoting achieved via this of the second sighting lever arm in relation to the base and also in relation to the first sighting lever arm. The constructive implementation using the rotating positioning element permits a compact design, which in particular also maintains the small dimensions for such sighting devices dimensioned for handguns, but at the same time enables the arrangement of a plurality of alignment elements, and thus permits a plurality of presets for the sighting device. In one preferred design variant, in particular six alignment elements can be provided on the rotating positioning element, so that six sighting basic settings can be performed.

The alignment elements can be arranged in particular along the circumference of a circle located in a plane perpendicular to the rotational axis and drawn around the intersection of the rotational axis with this plane. Such an arrangement represents an arrangement using which the respective alignment elements may be aligned very easily with respect to the buttress element and supported thereon. In particular, the alignment elements can also be arranged distributed at equal angle intervals around the rotational axis. Such a distribution permits the arrangement of a comparatively large number of alignment elements and facilitates the adjustment of the elevation of impact, since in each case pivoting the rotating positioning element by an equal angle results in the change from a first to an adjacent second alignment element.

The alignment elements can be formed in particular as grub screws, which are screwed into threaded holes in the rotating positioning element. The threaded holes then typically extend perpendicular to the first pivot axis here.

It can furthermore advantageously be provided that the positioning tips of the alignment elements are formed rounded, in particular in the form of a spherical cap, and the buttress element has a corresponding depression complementary to the shape of the rounded positioning tips of the alignment elements. A formfitting connection results between positioning tip of a set alignment element and buttress element due to such a design, so that the rotating positioning element is prevented from being inadvertently pivoted and thus the selected basic setting of the sighting device according to the invention unintentionally being lost. Due to the complementary design and the depression in the buttress element, a type of snap or catch connection thus results.

Furthermore, it can advantageously be provided that the rotating positioning element is arranged between the base and the first sighting lever arm, and an actuating element connected to the rotating positioning element to pivot the rotating positioning element around the rotational axis is provided on an upper side of the first sighting lever arm facing away from the base. Due to this design, the rotating positioning element, which is arranged concealed, can nonetheless be pivoted easily by using the actuating element arranged freely accessible on the upper side of the first sighting lever arm for this purpose.

To make the different basic settings of the sighting device predetermined by the plurality of the alignment elements in cooperation with the buttress element better identifiable, it is advantageous if corresponding markings are provided, on the basis of which the user can recognize which of the alignment elements is presently interacting with the buttress element and thus sets a preset basic setting of the sighting device. This can be carried out, for example, in that corresponding numbers are used for the marking, so that the shooter can perform, for example, basic settings from 1 to 6 and can then select them again easily in accordance with the markings. In the case of an actuating element provided as described above, corresponding markings can be arranged, for example, on the actuating element.

In order to have the alignment elements for setting the distance of the respective positioning tip to the rotating positioning element accessible in the design in which the rotating positioning element is arranged similarly concealed between the base and the first sighting lever arm, corresponding recesses can be provided in the actuating element which, when the corresponding alignment element is stopped with his positioning tip in the buttress element, are flush with a passage through the first sighting lever arm, so that the alignment element placed on the buttress element can be reached through the recess and the passage, for example, a grub screw can be engaged using a corresponding tool, for example, a hex socket.

In the sighting device according to the invention, in particular the first sighting lever arm can be pivotably mounted on the base around the first pivot axis, and the second sighting lever arm can be pivotably mounted on the first sighting lever arm. For this purpose, for example, corresponding pins can be guided as pivot axes through the base and the first sighting lever arm or can be guided through a section of the first sighting lever arm and the second sighting lever arm.

For simple adjustment of the positioning elements and for holding the pivot settings thus set of the two sighting lever arms, it can be provided that spring means pre-tension the first and the second sighting lever arm in a basic position, wherein this basic position is a pivot position of the two sighting lever arms to be oriented on the base. Thus, by pivoting the respective sighting lever arm away from the base, which is performed by actuating the respective positioning device, the spring means are tensioned and thus securely hold the sighting lever arms in the set pivot position by the counter pressure thus generated, so that the vertical setting of the sighting device can also be securely held.

In the sighting device according to the invention, the second positioning device can include in particular a set screw which is aligned with a thread axis perpendicular to the second pivot axis, is captively fixed on the second sighting lever arm in the direction of its thread axis, is rotatable around the thread axis in relation to the second sighting lever arm, and is screwed into a threaded hole in the first sighting lever arm. Using this set screw, by screwing the set screw into or out of the first sighting lever arm, respectively, the pivot position of the second sighting lever arm relative to the first sighting lever arm and thus also relative to the base can be changed. This second positioning device can, as already mentioned, in particular be used for a daily setting of the sighting device and thus the vertical point of impact of the firearm. To also give better orientation here to the shooter or the user of the sighting device, setting markings can also be provided for the second positioning device, for example, arranged on a head of a set screw provided as described above. This can be, for example, a scale graduation having a clearly marked zero position or the like.

To also be able to adjust the sighting device according to the invention with respect to a horizontal point of impact, it is advantageously provided that the rear sight device is adjustably fixed in its position on the second sighting lever arm in a direction parallel to the second pivot axis. A slide-type construction guided in a rail and displaceable by a set screw can be provided here, for example.

To be able to equip the sighting device according to the invention with different rear sights and rear sight shapes, it can advantageously be provided that the rear sight device has a rear sight part receptacle for removably fastening different rear sight parts. Such a rear sight part receptacle can accommodate the rear sight parts in a locking manner here or fastened by means of a fastening element, for example, a bayonet part or a screw. The rear sight parts can have, for example, the form of rear sight plates.

A further possible design of the invention provides that the sighting device according to the invention has a Picatinny rail in the base, which overlaps the region of the first and the second sighting lever arm. The arrangement of such a Picatinny rail enables further or other sighting apparatuses to be arranged on the sighting device according to the invention, for example, a light spot sight, or the like. Thus, for example, in shooting competition there are disciplines in which such sighting apparatuses are used. These can then be arranged on the sighting device according to the invention and fixed in the Picatinny rail without the sighting device having to be removed from the firearm, for example.

The sighting device according to the invention, as has already been mentioned in the explanation of the prior art for comparable sighting devices, can be designed as a separate unit for fastening on a firearm, in particular a handgun. However, it can also be designed as an integral component in a firearm, in particular a handgun, for example, as a component of a barrel assembly, a frame assembly, a breech, or a chamber housing.

BRIEF DESCRIPTION OF THE SEVERAL VIEWS OF THE DRAWINGS

Further advantages and features of the invention result from the following description of possible exemplary embodiments on the basis of the appended figures. In the figures.

DETAILED DESCRIPTION

Figure 1:
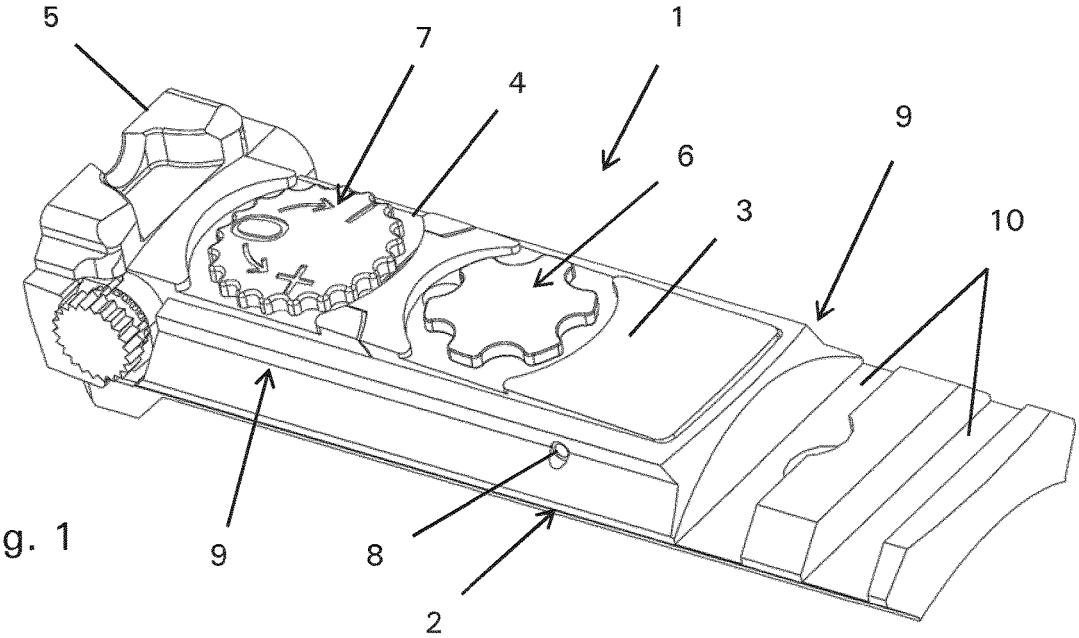
FIG. 1 shows a perspective view of an embodiment according to the invention of a sighting device.
Figure 2:
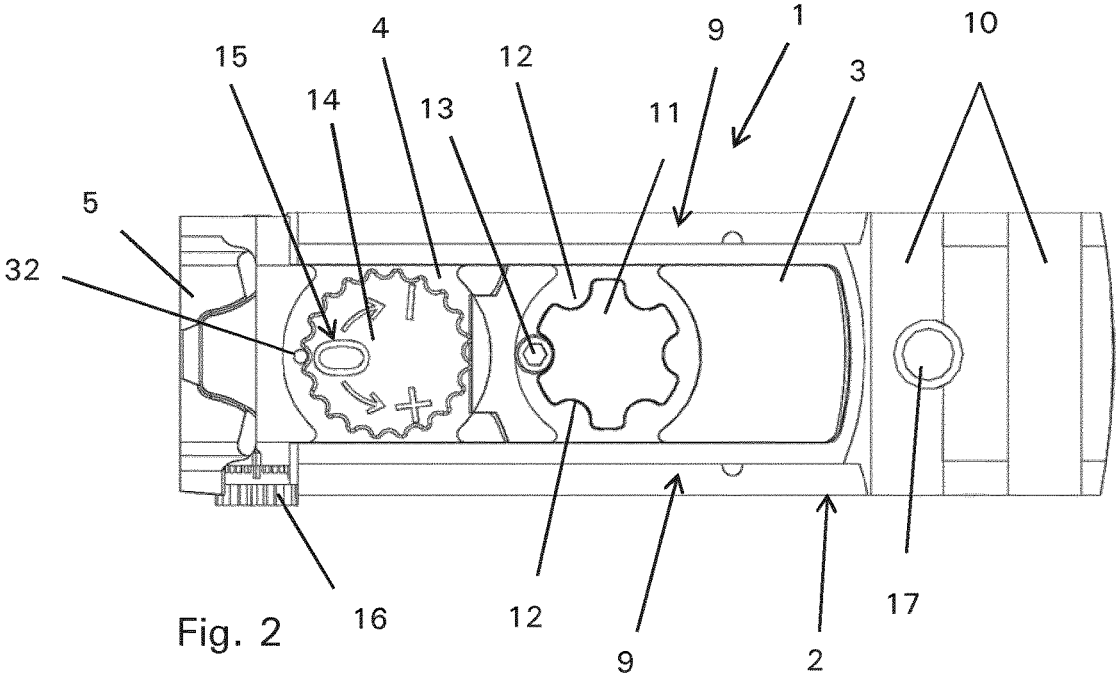
FIG. 2 shows a top view of the sighting device from FIG. 1.
Figure 3:
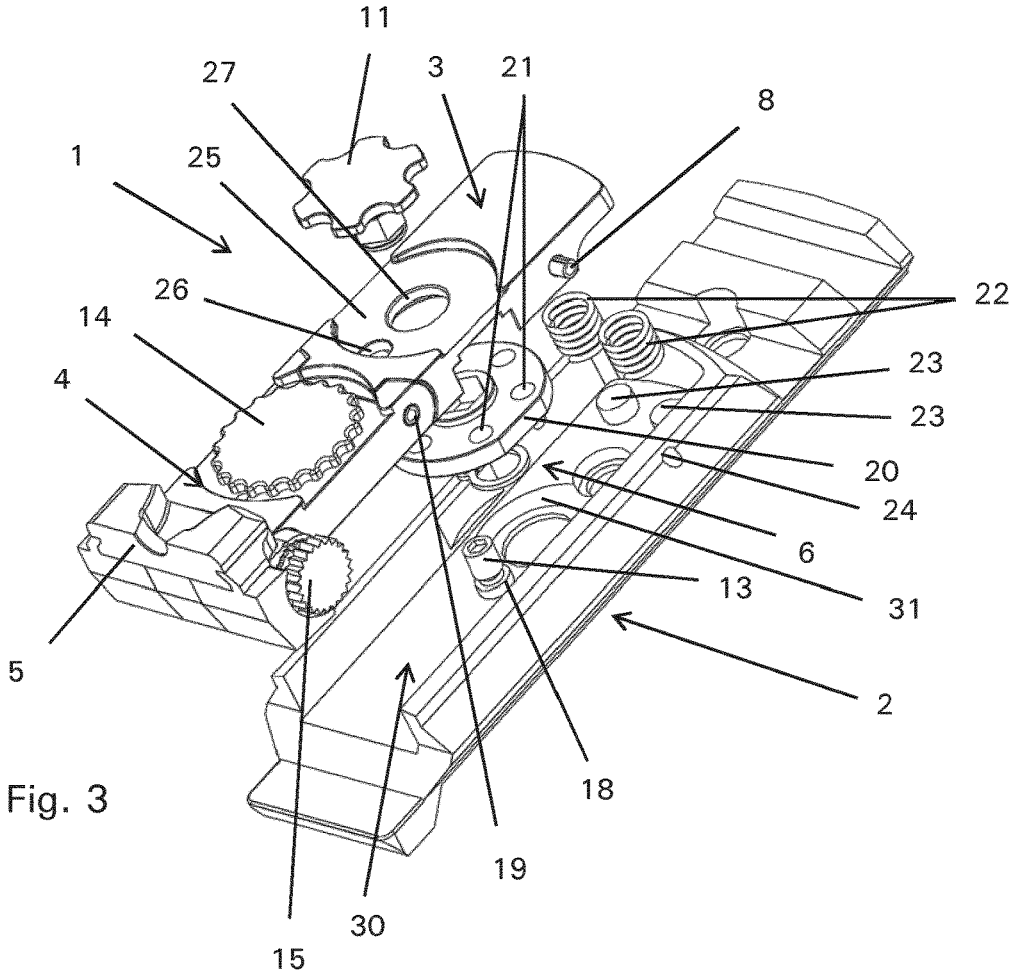
FIG. 3 shows an exploded view of the sighting device from FIG. 1.

In the figures, one possible embodiment of a sighting device according to the invention for firearms, in particular for handguns, is shown and is generally identified by the reference signs 1 in different views and with two design variants which differ in a detail.

The sighting device 1 contains three essential components, namely a base 2, a first sighting lever arm 3, and a second sighting lever arm 4. The first sighting lever arm 3 is mounted on the base 2 by means of a pin 8, the longitudinal axis of which defines a first pivot axis. For this purpose, holes 24 are provided in the base 2, through which the pin 8 is guided and furthermore through a hole (not shown in greater detail here) in the first sighting lever arm 3, which aligns with the holes 24.

The second sighting lever arm 4 is pivotably fixed via a pin 19, the longitudinal axis of which defines a second pivot axis, on the first sighting lever arm 4. A rear sight device 5 is arranged on the second sighting lever arm 14 on a longitudinal end opposite to the pin 19. This rear sight device contains a rear sight part receptacle (not shown in greater detail here), in which different rear sight parts can be arranged and fastened, which can have different rear sight geometries and/or rear sights of different designs. In the illustrations in the figures, a semicircular rear sight known per se is arranged in the rear sight device 5. The rear sight device 5 is configured so it is displaceable to adjust a lateral point of impact of the firearm equipped with the sighting device 1 according to the invention in a direction transverse, in particular perpendicular to a longitudinal direction of the arrangement made up of first sighting lever arm 3 and second sighting lever arm 4. A positioning mechanism to be operated via a set screw 16 is provided for adjusting the transverse position of the rear sight device 5.

Two positioning devices are provided for adjusting the point of impact of a firearm equipped with the sighting device 1 according to the invention, in particular a handgun, such as a pistol or a revolver. Using a first positioning device 6, the pivot position of the first sighting lever arm 3 is adjusted and additionally also a pivot position of the second sighting lever arm 4 connected to the first sighting lever arm 3 and thus the vertical position of the rear sight device 5. A second positioning device 7 enables a separate adjustment of the pivot position of the second sighting lever arm 4 relative to the first sighting lever arm 3 and the base 2, to thus also achieve a vertical adjustment of the rear sight device 5.

The two positioning devices, first positioning device 6 and second positioning device 7, are used for different adjustment options, as will be explained in greater detail hereinafter. The first positioning device 6 is thus designed for the purpose of performing a plurality of presets for the elevation of impact setting of the sighting device 1 and being able to change easily between these presets. The second positioning device 7 is used to adapt a sighting setting performed on the basis of a selected preset to special features occurring in the specific usage situation of the firearm equipped with the sighting device 1, for example, special light conditions or the like, and can be referred to as a daily sighting setting. The special feature of the sighting device 1 according to the invention is in the design of the first positioning device 6 here, which is explained in greater detail hereinafter with reference to the figures and elements shown therein.

Figure 4:
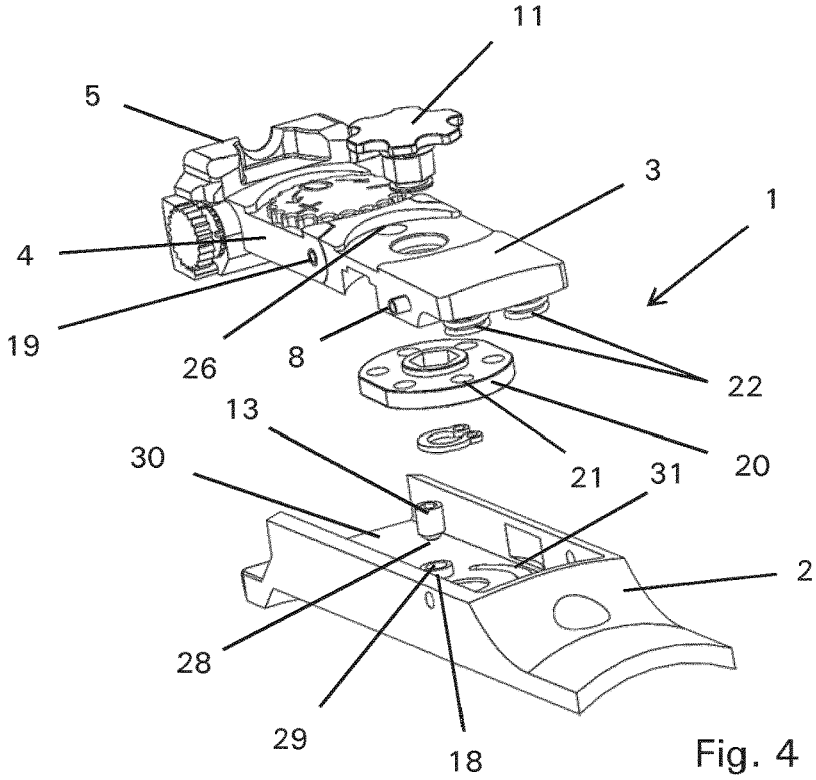
FIG. 4 shows an exploded view of a sighting device according to a second embodiment variant.
Figure 5:
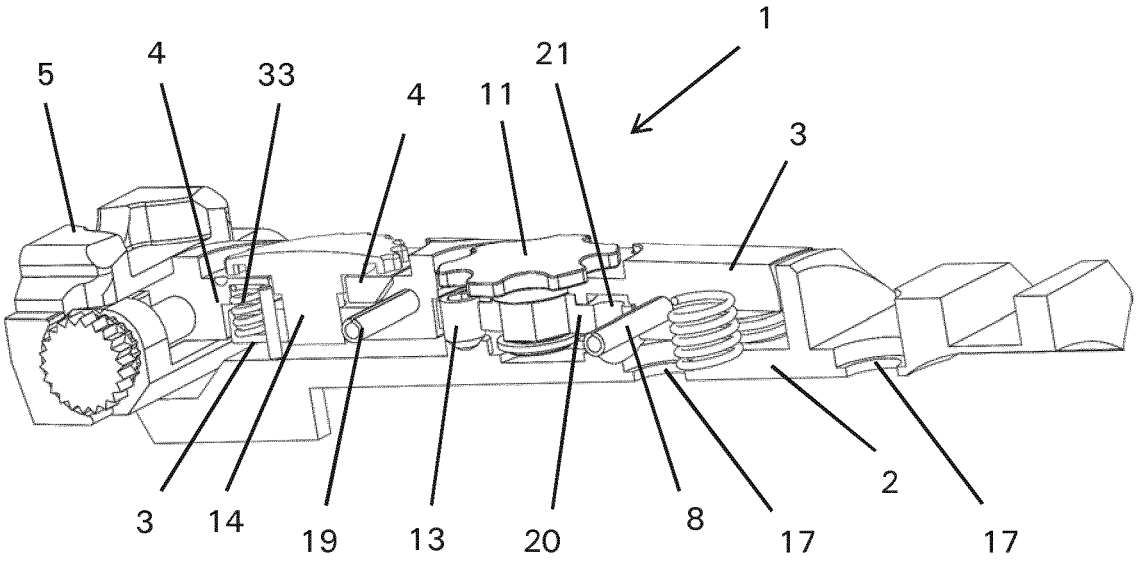
FIG. 5 shows a partially cutaway view of the sighting device from FIG. 1.

However, it is also to be noted here beforehand that the sighting device 1, as shown in FIGS. 1, 2, 3, and 5, has a so-called Picatinny rail formed on the base 2, which is a standardized attachment device for attaching accessory parts to firearms. The typical components of the Picatinny rail can be seen, namely the lateral wedge grooves or dovetail grooves 9, and the transverse grooves 10 guided transversely to the wedge grooves 9 and defined in the spacing by the standard. The special feature in the sighting device 1 according to the invention and the Picatinny rail embodied with it is that the Picatinny rail extends in a region beyond the first sighting lever arm 3 and the second sighting lever arm 4, i.e., extends almost up to the end of the base 2, on which the rear sight device 5 is arranged. This also enables, due to the flat design obtained by the construction shown of the sighting device 1, accessory parts, for example, a light spot sight, to be able to be placed on the sighting device 1 and fixed there with the aid of the Picatinny rail, without the sighting device 1 having to be removed from the firearm. In particular in conjunction with a handgun, such an accessory part can be arranged mounted on the firearm very far in the direction of the rear side opposite to the muzzle, which is a clear advantage for the usage comfort and the shooting performance. The sighting device 1 according to the invention can also be implemented without such a Picatinny rail, however, as shown in FIG. 4, for example. In all figures, the sighting device 1 is shown as an independent part, which can be fixed on a firearm via holes 17 in the base 2 by means of screws introduced therein, which are screwed into corresponding threaded holes in a counterpart on the firearm. However, it is just as possible in the scope of the invention to design the sighting device 1 according to the invention as a fixed and integral component of a firearm, wherein then in particular the base 2 is formed integrated in a component of the firearm.

The special feature of the first positioning device 6, using which the plurality of preset vertical points of impact of the sighting device 1 or the firearm equipped with it can be adjusted and selected comfortably, will be explained in greater detail hereinafter.

The core of the first positioning device 6 is a rotating positioning element 20, which is formed disk-shaped in the embodiment shown and is arranged between the base 2, more precisely the bottom 30 of the base 2, and the first sighting lever arm 3. The rotating positioning element 20 is arranged in the first sighting device 1 rotatably around a rotational axis extending perpendicularly to the plane of the bottom 30 and also perpendicularly to the first pivot axis, wherein an actuating element 11 is provided, which is connected here in a formfitting manner to the rotating positioning element 20 using a hexagon extension and via which the rotating positioning element 20 can be pivoted around the rotational axis. The hexagon extension protrudes here through a passage 27 in the first sighting lever arm 3. A lock ring (not provided with a reference sign) secures the actuating element 11 axially on the rotating positioning element 20. The actuating element 11 is arranged in a depression 25 in the first sighting lever arm, which secures the actuating element 11, in particular from possible impacts or unintentional pivoting.

The rotating positioning element 20 has a total of six threaded holes 21 arranged circularly and with uniform angle distribution around the rotational axis, which protrude through the rotating positioning element 20. Grub screws 13, which form of alignment elements, are screwed into the threaded holes 21. Only one grub screw 13 is shown in each of the figures here, to make the figures more comprehensible. In general, grub screws 13 are screwed in each case into all six threaded holes 21. In principle, however, threaded holes 21 can also remain free without deviating from the invention. The invention thus does not presume equipping all threaded holes 21 with grub screws 13.

A buttress element 18, which is elevated in relation to the surroundings and which has a frontal depression 29 on an upper end, is formed on the bottom 30 of the base 2. This depression 29 is formed complementary to the shape of a positioning tip 28 of the grub screws 13, so that these positioning tips 28 of the grub screws 13 can engage in a formfitting manner in the depression 29. The buttress element 18 is arranged at a distance from the rotational axis which corresponds to the distance of the threaded holes 21 on the rotating positioning element 20 from the rotational axis. Accordingly, the threaded holes 21 can each be brought into a flush alignment with the buttress element 18, so that the grub screw 13 arranged in the aligned threaded hole 21 engages with its positioning tip 28 in the depression 28 of the buttress element 18. A ring groove 31 is introduced into the bottom 30 of the base 2 extending around the rotational axis in a radius corresponding to the distance of the threaded holes 21 from the rotational axis, which is used to accommodate the grub screws 13 which are not flush with the buttress element 18 and placed with their positioning tip 28 in the depression 29, more precisely their positioning tips 28, so that they are without contact with the bottom 30 of the base 2.

Two compression springs 22 are fixed on cylindrical spring seats 23 on the bottom 30 of the base 2 and press against a short lever arm of the first sighting lever arm 3, which is on the side of the pin 8 opposite to the positioning device 7 and thus the first pivot axis. These compression springs 22 press the arrangement made up of first sighting lever arm 3 and second sighting lever arm 4 in a pivot direction toward the base 2 into a basic position.

To perform a sighting vertical adjustment via the presets using the total of six grub screws 13 arranged in the threaded holes 21, firstly one of the grub screws 13 is placed with its positioning tip 28 in the depression 29 of the buttress element 18 by rotating the rotating positioning element 20 by means of the actuating element 11 around the rotational axis so that the grub screw 13 is positioned in appropriate correspondence with the buttress element 18. In this position, the grub screw 13 can be reached using a tool, for example, a hex socket, through a recess 12 in the actuating element 11 and through an opening 26 accessible through the recess 12, which extends through the first sighting lever arm 3. By screwing the grub screw 13 into or out of the threaded hole 21, the distance of the rotating positioning element 20 to the base 2, more precisely to the bottom 30 of the base 2, is changed and thus the pivot angle of the first sighting lever arm 3 and also the second sighting lever arm 4 fastened thereon is changed. A vertical adjustment of the rear sight device 5 is thus obtained. If the desired elevation of impact is achieved, which is verified by corresponding test shots, by pivoting the rotating positioning element 20, which is achieved by rotating the actuating element 11, a further grub screw 13 in another threaded hole 21 is placed on the buttress element 18 and using corresponding adjustment of the screw position of this grub screw 13, a different sighting basic setting is set with regard to the elevation of impact, for example, for a differing shooting distance.

There is now the option of performing a total of six different sighting basic settings, in that the six grub screws 13 screwed into the threaded holes 21 are each placed on the buttress element 18 and then adjusted in their height by corresponding screwing. Via the counter pressure exerted by the compression springs 22, the respective grub screw 13 is pressed with its positioning tip 28 into the depression 29 of the of the buttress element 18, so that the vertical setting of the rear sight device 5, which is obtained by the pivot position of the first sighting lever arm 3 with the second sighting lever arm 4 fastened thereon, is maintained.

The user of the sighting device 1 or the firearm provided with it can now select the matching sighting basic setting in different shooting situations, for example, in different competitive disciplines, by pivoting the actuating element 11 and thus adjusting the rotating positioning element 20 such that the associated grub screw 13 rests on the buttress element 18 and the corresponding sighting basic setting is selected. In order that the user can more easily identify the sighting basic setting performed by him in the first positioning device 6, corresponding markings are advantageously arranged on the actuating element 11, for example, numbers from 1 to 6 applied in the region of the recesses 12.

To pivot the rotating positioning element 20 by means of the actuating element 11, the user only has to slightly raise the first sighting lever arm 3 (possibly together with the second sighting lever arm 4), i.e., pivot it away from the bottom 30 of the base 2, and can then rotate the actuating element 11 and thus align it, such that the desired grub screw 13 rests with its positioning tip 28 in the depression 29 of the buttress element 18. The circumferential recesses 12 on the actuating element 11 help to recognize this position in this case. If the grub screw 13 is aligned with the buttress element 18, the user can lower the first sighting lever arm 3 again, wherein the compression springs 22 ensure a corresponding counter pressure which presses the grub screw 13 with its positioning tip 28 into the depression 29 of the buttress element 18 and fixes it in a formfitting manner therein, as it were holds it locked. This thus prevents the selected position of the first positioning device from being able to be changed unintentionally.

To additionally give the shooter the option of performing a daily setting of the sighting device 1 with its elevation of impact for a selected basic setting, the second positioning device 7 is provided. It includes a set screw 14, which is fixed immovably on the second sighting lever arm 4 in the direction of its longitudinal axis and is screwed with its screw thread into a threaded hole in the first sighting lever arm 3. By further screwing the set screw 14 into or out of the thread in the first sighting lever arm, a pivot angle of the second sighting lever arm 4 can thus be adjusted in relation to the first sighting lever arm 3 and therefore also in relation to the base. The pin 19, as already mentioned, defines the second pivot axis, around which the second sighting lever arm is pivoted in relation to the first sighting lever arm 3 by pivoting the set screw 14. Thus, with a preset selected once, as is set using the first positioning device 6, a further vertical adjustment of the rear sight device 5 can be performed and thus a point of impact correction can be carried out. To give a scale for the user here and to enable easy comprehension of the daily sighting setting, a corresponding marking 15 is provided on the set screw 14. A basic position is indicated here by a "0", positioning directions for raising or lowering the point of impact are identified with arrows having the signs "+" and "−". A tooth-like knurling of the edge of the head of the set screw 14 and a point marking 32 on the second sighting lever arm 4 facilitate the orientation of the rotational positions and thus a recognition of the adjustment by means of the second positioning device 7. The second sighting lever arm 4 is pre-tensioned in relation to the first sighting lever arm 3 in a pivot direction facing away from the base 2 via at least one compression spring 33 arranged between the first sighting lever arm 3 and the second sighting lever arm 4. This pre-tension holds the set screw 14 in the selected screw position and prevents unintentional adjustment of the second positioning device 7.

The option is thus provided by the sighting device 1 according to the invention of performing a plurality of presets of the elevation of impact of a firearm equipped with the sighting device 1 and leaving them fixed and simply selecting them, for example, adapted to different competitive disciplines having different target distances or also adapted to different ammunition used, for example, having different charges. A daily sighting setting can also be performed via the second positioning device 7 to be able to react to special features at the time of shooting, for example, on the competition day, for example, particular light conditions, or the like. It is not necessary here to change the sighting basic setting(s).

The sighting device 1 according to the invention is very functional and can exercise further functions by way of the possible additional designs, for example, the Picatinny rail. The sighting device 1 according to the invention is distinguished by a flat design and compact construction, so that in particular it can also be integrated in handguns, even those of filigree design, or attached thereon, without impairing the use of these firearms or also interfering with the design.

LIST OF REFERENCE NUMERALS

1 sighting device
2 base
3 first sighting lever arm
4 second sighting lever arm
5 rear sight device
6 first positioning device
7 second positioning device
8 pin
9 wedge groove
10 transverse groove
11 actuating element
12 recess
13 grub screw
14 set screw
15 marking
16 set screw
17 hole
18 buttress element
19 pin
20 rotating positioning element
21 threaded hole
22 compression spring
23 spring seat
24 hole
25 depression
26 opening
27 passage
28 positioning tip
29 depression
30 bottom
31 ring groove
32 point marking
33 compression spring

The invention claimed is:

1. A sighting device for firearms comprising:

a base;

a first sighting lever arm pivotable relative to the base around a first pivot axis;

a second sighting lever arm pivotable relative to the base and relative to the first sighting lever arm around a second pivot axis, wherein the second pivot axis extends in parallel to the first pivot axis;

a rear sight device fixed on the second sighting lever arm;

a first positioning device for adjusting a pivot angle of the first sighting lever arm relative to the base; and a second positioning device for adjusting a pivot angle of the second sighting lever arm relative to the first sighting lever arm and relative to the base;

wherein the first positioning device has a rotating positioning element, which is fixed on the first sighting lever arm, is pivotable around a rotational axis extending perpendicularly to the first pivot axis, and is equipped with a plurality of alignment elements arranged distributed in different angle positions around the rotational axis;

wherein the plurality of alignment elements each have a positioning tip oriented toward a bottom of the base and are fixedly alignable relative to the rotating positioning element such that a distance of the positioning tip to the rotating positioning element is variably adjustable in a direction parallel to the rotational axis; and wherein a buttress element elevated over a surrounding region covered by the rotating positioning element is provided on the bottom of the base to interact with one of the positioning tips at a time.

2. The sighting device as claimed in claim 1, wherein the plurality of alignment elements is arranged along a circumference of a circle located in a plane perpendicular to the rotational axis and drawn around an intersection of the rotational axis with the plane.

3. The sighting device as claimed in claim 1, wherein the plurality of alignment elements is arranged distributed at equal angle intervals around the rotational axis.

4. The sighting device as claimed in claim 1, wherein the rotating positioning element has precisely 6 alignment elements arranged distributed around the rotational axis.

5. The sighting device as claimed in claim 1, wherein the plurality of alignment elements is formed as grub screws, which are screwed into threaded holes in the rotating positioning element.

6. The sighting device as claimed in claim 1, wherein the positioning tips of the plurality of alignment elements is formed rounded, and in that the buttress element has a corresponding depression complementary to the shape of the rounded positioning tips of the plurality of alignment elements.

7. The sighting device as claimed in claim 6, wherein the positioning tips of the plurality of alignment elements is in the form of a spherical cap.

8. The sighting device as claimed in claim 1, wherein the rotating positioning element is arranged between the base and the first sighting lever arm, and an actuating element fixedly connected to the rotating positioning element for pivoting the rotating positioning element around the rotational axis is arranged on an upper side of the first sighting lever arm facing away from the base.

9. The sighting device as claimed in claim 8, further comprising markings on the actuating element to identify a rotational position of the rotating positioning element.

10. The sighting device as claimed in claim 8, further comprising recesses provided circumferentially in the actuating element, through which an alignment element of the plurality of alignment elements arranged in the rotating positioning element is accessible at least in one rotational position for an adjustment of the positioning tip relative to the rotating positioning element.

11. The sighting device as claimed in claim 1, wherein the first sighting lever arm is mounted pivotably around the first pivot axis on the base, and the second sighting lever arm is mounted pivotably on the first sighting lever arm.

12. The sighting device as claimed in claim 1, further comprising a spring which pre-tensions the first sighting lever arm and the second sighting lever arm in a basic position, wherein the basic position is a pivot position of the first and second sighting lever arms oriented toward the base.

13. The sighting device as claimed in claim 1, wherein the second positioning device includes a set screw, which is aligned having a thread axis perpendicular to the second pivot axis, is fixed immovably on the second sighting lever arm in the direction of the thread axis, is rotatable in relation to the second sighting lever arm around the thread axis, and is screwed into a threaded hole in the first sighting lever arm.

14. The sighting device as claimed in claim 13, further comprising setting markings applied to a head of the set screw.

15. The sighting device as claimed in claim 1, wherein the rear sight device is fixed adjustably in position on the second sighting lever arm in a direction parallel to the second pivot axis.

16. The sighting device as claimed in claim 1, wherein the rear sight device has a rear sight part receptacle for releasably fastening different rear sight parts thereto.

17. The sighting device as claimed in claim 1, wherein a Picatinny rail is formed in the base, and the Picatinny rail overlaps the region of the first and second sighting lever arms.

18. The sighting device as claimed in claim 1 designed as a separate unit for fastening on a firearm.

19. The sighting device as claimed in claim 1 formed integrated in a firearm as part of a barrel assembly, a breech, a frame assembly, or a chamber housing.

20. The sighting device as claimed in claim 1 provided on a handgun.

* * * * *